US010907284B2

(12) United States Patent
Ito et al.

(10) Patent No.: US 10,907,284 B2
(45) Date of Patent: Feb. 2, 2021

(54) NONWOVEN FABRIC AND METHOD OF MANUFACTURING SAME

(71) Applicant: Toray Fine Chemicals Co., Ltd., Tokyo (JP)

(72) Inventors: Masashi Ito, Ehime (JP); Takaki Omasa, Osaka (JP); Shintaro Kataoka, Ehime (JP); Takehiko Hirabara, Osaka (JP)

(73) Assignee: Toray Fine Chemicals Co., Ltd., Tokyo (JP)

( * ) Notice: Subject to any disclaimer, the term of this patent is extended or adjusted under 35 U.S.C. 154(b) by 434 days.

(21) Appl. No.: 15/558,351

(22) PCT Filed: Mar. 16, 2016

(86) PCT No.: PCT/JP2016/058265
§ 371 (c)(1),
(2) Date: Sep. 14, 2017

(87) PCT Pub. No.: WO2016/148174
PCT Pub. Date: Sep. 22, 2016

(65) Prior Publication Data

US 2018/0066386 A1 Mar. 8, 2018

(30) Foreign Application Priority Data

Mar. 16, 2015 (JP) ..... 2015-052385

(51) Int. Cl.
*D04H 3/007* (2012.01)
*D04H 3/16* (2006.01)

(52) U.S. Cl.
CPC ..... *D04H 3/007* (2013.01); *D04H 3/16* (2013.01)

(58) Field of Classification Search
CPC ..... D04H 3/007; D04H 3/16
See application file for complete search history.

(56) References Cited

U.S. PATENT DOCUMENTS 4,874,659 A * 10/1989 Ando ..... B01D 39/083 428/221
6,074,869 A 6/2000 Pall et al.
(Continued)

FOREIGN PATENT DOCUMENTS

JP 01-192860 A 8/1989
JP 03-591158 A 3/1991
(Continued)

OTHER PUBLICATIONS

English translation of WO 2012/102398 to Tamura et al. obtained from Google Patents website. (Year: 2012).*
(Continued)

*Primary Examiner* — Jeremy R Pierce
(74) *Attorney, Agent, or Firm* — DLA Piper LLP (US)

(57) ABSTRACT

A highly uniform nonwoven fabric has high air permeability while it has a small maximum pore diameter. The nonwoven fabric includes: ultra-fine fibers, wherein the ultra-fine fibers have an average fiber diameter of 0.80 μm or less, the proportion of the number of the ultra-fine fibers having a fiber diameter of 2.00 μm or more is 5.0% or less, and the nonwoven fabric has an apparent density of not less than 0.05 g/cm$^3$ and not more than 0.15 g/cm$^3$ and has a maximum pore diameter of 10.0 μm or less.

3 Claims, 2 Drawing Sheets

(56) References Cited

U.S. PATENT DOCUMENTS

| | | | | |
|---|---|---|---|---|
| 8,277,711 | B2 | 10/2012 | Huang et al. | |
| 2010/0037576 | A1* | 2/2010 | Claasen | D01D 5/0985 55/523 |
| 2010/0195270 | A1* | 8/2010 | Hayakawa | B32B 5/022 361/502 |
| 2013/0065133 | A1 | 3/2013 | Suzuki et al. | |
| 2013/0122771 | A1* | 5/2013 | Matsubara | D01D 5/084 442/351 |
| 2013/0266874 | A1 | 10/2013 | Matsubara et al. | |
| 2014/0038024 | A1* | 2/2014 | Huang | H01M 2/162 429/144 |
| 2014/0363653 | A1* | 12/2014 | Hori | C02F 1/285 428/219 |
| 2015/0171397 | A1* | 6/2015 | Yamada | H01M 2/162 429/144 |
| 2016/0243788 | A1* | 8/2016 | Steiner | D04H 1/492 |
| 2016/0263297 | A1 | 9/2016 | Suzuki et al. | |
| 2017/0233913 | A1* | 8/2017 | Shimada | D04H 3/14 429/253 |

FOREIGN PATENT DOCUMENTS

| | | | |
|---|---|---|---|
| JP | 05-283053 | A | 10/1993 |
| JP | 10-204766 | A | 8/1998 |
| JP | 2001-081660 | A | 3/2001 |
| JP | 2006-37339 | A | 2/2006 |
| JP | 2010-125404 | A | 6/2010 |
| JP | 2010-522835 | A | 7/2010 |
| JP | 2010-285720 | A | 12/2010 |
| JP | 2014-024061 | A | 2/2014 |
| JP | 2014-036929 | A | 2/2014 |
| JP | 2015-092038 | A | 5/2015 |
| JP | 2015-190081 | A | 11/2015 |
| WO | 92/16977 | A1 | 10/1992 |
| WO | 2011/136133 | A1 | 11/2011 |
| WO | 2012/014501 | A1 | 2/2012 |
| WO | 2012/102398 | A1 | 8/2012 |
| WO | 2015/056603 | A1 | 4/2015 |

OTHER PUBLICATIONS

Office Action dated Mar. 31, 2020, of counterpart Japanese Application No. 2019-041104, along with an English translation.

Written Submission of Publications dated Mar. 4, 2020, of counterpart Japanese Application No. 2019-041104, along with an English translation.

Notice of Reasons for Refusal dated Aug. 25, 2020, of counterpart Japanese Application No. 2019-041104, along with an English translation.

Reasons for Submission dated Jun. 26, 2020, of counterpart Japanese Application No. 2019-041104, along with an English translation.

* cited by examiner

NONWOVEN FABRIC AND METHOD OF MANUFACTURING SAME

TECHNICAL FIELD

This disclosure relates to a nonwoven fabric and a method of manufacturing the same.

BACKGROUND

Heretofore, nonwoven fabrics composed of ultra-fine fibers are used as various types of filters. Nonwoven fabrics composed of fibers having small fiber diameters exhibit excellent fine particle-capturing performance, and thus are used as liquid filters, air filters and the like. In particular, concerning a meltblown nonwoven fabric manufactured by spinning a molten thermoplastic resin, studies have been made to form the nonwoven fabric using fibers having small fiber diameters. For example, it has been proposed to obtain ultra-fine fibers in a melt blowing process by irradiating extruded fibers with heat rays (see JP 2010-285720 A, for example). Also, there has been proposed a method of manufacturing a meltblown nonwoven fabric while preventing entanglement of fibers and adherence of floating fibers, which are liable to occur when manufacturing a nonwoven fabric using ultra-fine fibers with small fiber diameters. The meltblown nonwoven fabric manufactured by this method can attain both high fine particle-capturing performance and high air permeability while it has a low basis weight (see WO 2012/102398, for example).

On the other hand, there have been proposed a method of obtaining ultra-fine fibers by a process different from a melt blowing process and also obtaining a nonwoven fabric composed of the thus-obtained ultra-fine fibers (see Japanese Patent No. 5394368, for example). JP'368 discloses that an ultra-fine fiber nonwoven fabric with favorable fiber diameter distribution can be obtained. However, while the homogeneity as a nonwoven fabric sheet, the basis weight, the thickness, and the like of the nonwoven fabric are important to apply the nonwoven fabric to filter use, these factors are not described in JP'368. Accordingly, even if ultra-fine fibers are obtained by the method disclosed in JP '368, they are not readily applicable to filter use.

Furthermore, to obtain a meltblown nonwoven fabric including a smaller amount of thick fibers generated by fusion of fibers, there has been propose a method in which fibers extruded from a spinneret are blown by high-temperature and high-speed air, then cooled with cooling air, and dispersed (see JP 2015-92038 A, for example). Also, there has been propose a method of obtaining a ultra-fine fiber nonwoven fabric having a high specific surface area by setting a maximum shear rate of a thermoplastic resin that is being stretched within a predetermined range (see JP2015-190081 A, for example).

In technical fields where microfiltration is required when filtering liquids, membrane filters are typically used. However, the membrane filters clog fast. On this account, there are demands for an ultra-fine fiber nonwoven fabric having a small maximum pore diameter (the maximum pore diameter serves as an index of the filtration accuracy of a liquid filter).

A meltblown nonwoven fabric has a very wide fiber diameter distribution. Thus, even when the average fiber diameter is small, the meltblown nonwoven fabric may have a large maximum fiber diameter owing to the presence of thick fibers. In such a case, the nonwoven fabric may have hollow spaces generated by the presence of the thick fibers, resulting in an increase in maximum pore diameter. This is caused by the fact that a melt blowing process includes the steps of: extruding a polymer from a spinning nozzle; then blowing hot air onto the polymer from side surfaces of the nozzle, thereby making the polymer thinner and cooling the polymer; and forming a nonwoven fabric by collecting the thus-obtained fibers on a net placed below. In general, meltblown nonwoven fabrics have a wide fiber diameter distribution due to the presence of thick fibers generated partially by various factors such as: the degree to which the polymer is stretched, affected by the diameter of a molten polymer immediately after being extruded, and the temperature, flow rate, and velocity of hot air; fusion of fibers and tearing of the polymer due to the disturbance of the flow of the hot air; and tearing of fibers after the polymer has been solidified. Thus, it is difficult to obtain a nonwoven fabric with a uniform fiber diameter by a melt blowing process. Further, the polymer immediately after being extruded from the spinning nozzle causes a phenomenon called the "Barus effect," which is the swelling of the polymer upon release from the extrusion pressure by the nozzle. The difference in degree of the swelling also contributes to the fiber diameter distribution. The pore diameter, that indicates the size of a hollow space formed among fibers, is affected greatly by a maximum fiber diameter of the fibers and the presence or absence of shots (resin lumps). Accordingly, even when the average fiber diameter is made smaller, the maximum pore diameter may be larger.

It is known that the above-described Barus effect occurs when the amount of a resin extruded per orifice of the nozzle is large or when the resin has a high viscosity. However, an attempt to reduce the amount of the extruded resin or to lower the viscosity of the resin to prevent occurrence of the Barus effect causes a drop in the back pressure so that the force to extrude the polymer (the amount of the polymer extruded) tends to be unstable. This may be a factor contributing to the formation of shots. Thus, these approaches to the Barus effect have limitations.

On the other hand, as a method of reducing maximum pore diameter, laminating a plurality of nonwoven fabrics or calendering a nonwoven fabric is commonly employed. However, filters obtained by these methods tend to have low air permeability, clog fast, and have a short life.

It could therefore be helpful to provide a highly uniform nonwoven fabric having high air permeability and a small maximum pore diameter, and a method of manufacturing the same.

SUMMARY

We thus provide:

A nonwoven fabric includes: ultra-fine fibers, wherein the ultra-fine fibers have an average fiber diameter of 0.80 μm or less, a proportion of the number of the ultra-fine fibers having a fiber diameter of 2.00 μm or more is 5.0% or less, and the nonwoven fabric has an apparent density of not less than 0.05 g/cm$^3$ and not more than 0.15 g/cm$^3$ and has a maximum pore diameter of 10.0 μm or less.

In the nonwoven fabric, it is preferable that a value obtained by dividing an air permeability (cm$^3$/cm$^2$/sec) by the maximum pore diameter (μm) (Air permeability [cm$^3$/cm$^2$/sec]/Maximum pore diameter [μm]) is 1.30 or more.

In the nonwoven fabric, it is preferable that the ultra-fine fibers are formed of a thermoplastic resin.

In the nonwoven fabric, it is preferable that the ultra-fine fibers are formed of polypropylene.

The nonwoven fabric preferably is a meltblown nonwoven fabric.

The nonwoven fabric preferably has an average basis weight of at least 9 g/m$^2$.

We also provide a method of manufacturing a nonwoven fabric by a melt blowing process, wherein an amount of a resin extruded per orifice of a spinning nozzle is set to 0.01 g/min or less, a die temperature is set so that the resin exhibits a melt flow rate of not less than 500 g/10 min and not more than 1000 g/10 min at the die temperature, a temperature of air ejected to be blown to the resin at a nozzle exit is set to a temperature at which the resin exhibits a melt flow rate (MFR) corresponding to not less than 20% and not more than 80% of the melt flow rate at the die temperature, and an amount of the air ejected per unit area is set to not less than 50 Nm$^3$/sec/m$^2$ and not more than 70 Nm$^3$/sec/m$^2$.

It is thus possible to provide a highly uniform nonwoven fabric having high air permeability and a small maximum pore diameter, and a method of manufacturing the same.

BRIEF DESCRIPTION OF THE DRAWINGS

FIG. 2A shows the fiber diameter distribution in a nonwoven fabric of Example 1. FIG. 2B shows the fiber diameter distribution in a nonwoven fabric of Example 4. FIG. 2C shows the fiber diameter distribution in a nonwoven fabric of Comparative Example 1.

DETAILED DESCRIPTION

Figure 1:
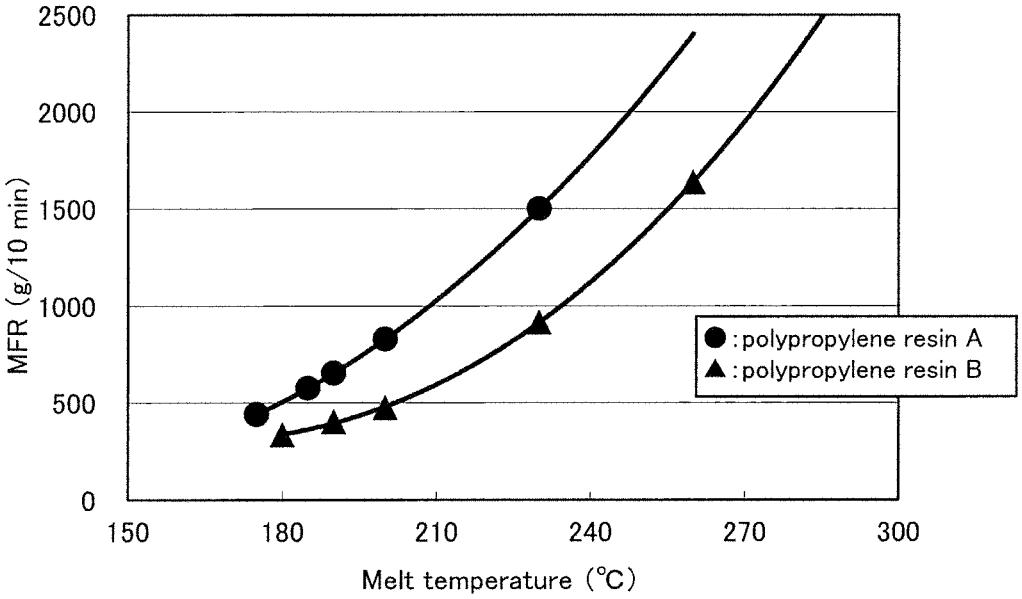
FIG. 1 is a graph showing, regarding resins used in an example, the relationship between melt temperatures and melt flow rates at the melt temperatures.

Our fabrics and methods will be described more specifically below. The nonwoven fabric is composed of fibers with fiber diameters in a predetermined range and has an apparent density in a predetermined range. With this configuration, the nonwoven fabric can achieve high air permeability while the maximum pore diameter thereof is small (10.0 μm or less). As for the properties of a nonwoven fabric to be used as a filter, an attempt to enable collection of finer particles is generally made by reducing the average fiber diameter of the nonwoven fabric. However, reducing the average fiber diameter does not necessarily provide satisfactory properties. We focused on a maximum fiber diameter of fibers composing a nonwoven fabric, and discovered a highly uniform nonwoven fabric having high air permeability while it has a small maximum pore diameter and a method of manufacturing the same.

The nonwoven fabric is composed of ultra-fine fibers having an average fiber diameter of 0.80 μm or less, the proportion of the number of the ultra-fine fibers having a fiber diameter of 2.00 μm or more is 5.0% or less, and the nonwoven fabric has an apparent density of not less than 0.05 g/cm$^3$ and not more than 0.15 g/cm$^3$ and has a maximum pore diameter of 10.0 μm or less.

In the nonwoven fabric, it is necessary that the ultra-fine fibers have an average fiber diameter of 0.80 μm or less, and further, that the proportion of the number of the ultra-fine fibers having a fiber diameter of 2.00 μm or more is 5.0% or less. It is more preferable that the nonwoven fabric is composed of the ultra-fine fibers with a maximum fiber diameter of less than 2.00 μm. When the nonwoven fabric includes more than 5.0% of the fibers with the maximum fiber diameter of 2.00 μm or more, the nonwoven fabric is liable to have a large maximum pore diameter even when the average fiber diameter is 0.80 μm or less. An increase in maximum pore diameter causes a problem in that the nonwoven fabric may exhibit insufficient fine particle-capturing performance when it is used as a filter. The average fiber diameter preferably is 0.50 μm or less. Also, it is more preferable that the proportion of the number of the ultra-fine fibers having a fiber diameter of 2.00 μm or more is 3.0% or less, and it is more preferable that the maximum fiber diameter is 1.50 μm or less. The term "proportion of the number of fibers" as used herein means the proportion of the number of fibers having a fiber diameter in a specific range in 200 fibers, as explained below in connection with methods of determining fiber diameters.

The nonwoven fabric has an apparent density of not less than 0.05 g/cm$^3$ and not more than 0.15 g/cm$^3$ and has a maximum pore diameter of 10.0 μm or less. Preferably, the apparent density is not less than 0.08 g/cm$^3$ and not more than 0.12 g/cm$^3$. An attempt to reduce the maximum pore diameter by laminating nonwoven fabrics or calendering a nonwoven fabric may result in a higher apparent density, lower air permeability, and a shorter life when used as a filter. In contrast, the nonwoven fabric can have a maximum pore diameter of 10.0 μm or less while the apparent density thereof is in the above-descried range. The maximum pore diameter preferably is 8.0 μm or less.

The term "apparent density" is a value calculated according to the following equation using the average thickness and the average basis weight of a nonwoven fabric determined in manners to be described below. It can be said that a nonwoven fabric having a smaller apparent density is bulkier.

$$\text{Apparent density (g/cm}^3\text{)} = \{\text{Average basis weight (g/m}^2\text{)/Average thickness (mm)}\}/1000$$

It is desirable that the average basis weight is higher considering the workability and the like in a subsequent step in handling the nonwoven fabric. Preferably, the average basis weight of the nonwoven fabric is at least 9 g/m$^2$.

It is possible to obtain a nonwoven fabric in which the value of the air permeability (cm$^3$/cm$^2$/sec)/the maximum pore diameter (μm) is 1.30 or more. When the value of the air permeability (cm$^3$/cm$^2$/sec)/the maximum pore diameter (μm) is 1.30 or more, the nonwoven fabric has high air permeability while it has a small maximum pore diameter. Thus, when such a nonwoven fabric is used as a liquid filter, it can serve as a long life filter that is less liable to clog and can maintain high filtration accuracy. The nonwoven fabric with this configuration can be used suitably as a nonwoven fabric for use as a liquid filter.

The ultra-fine fibers composing the nonwoven fabric are formed of a thermoplastic resin. The ultra-fine fibers are not particularly limited as long as they are formed of a thermoplastic resin, examples of which include polyester, polyolefin, polyamide, and polyphenylene sulfide. In particular, it is preferable that the ultra-fine fibers are formed of polypropylene. Any known polypropylene resin can be used. However, when a nonwoven fabric is manufactured by a melt blowing process to be described below, it is preferable that a polypropylene resin exhibits a melt flow rate (MFR) of not less than 10 g/10 min and not more than 2000 g/10 min. MFR, which indicates a physical property of a resin, is measured by a standard test method pursuant to JIS K7210-1. MFR of a polypropylene resin is a value measured under the following measurement conditions: 2.16 kg and 230° C. (measurement conditions prescribed for polypropylene resins in JIS K6921-2).

Preferably, the nonwoven fabric is a meltblown nonwoven fabric. In a melt blowing process, at the time of extruding a molten resin through orifices of a spinning nozzle in fibrous forms, compressed gas (e.g., air) is blown onto the extruded fibrous molten resin from both side surfaces of the nozzle and, also, the compressed gas is caused to flow along the fibrous molten resin, whereby the fiber diameters can be reduced. As described above, according to the melt blowing process, a nonwoven fabric composed of ultra-fine fibers having an average fiber diameter of 0.80 μm or less can be obtained easily. Thus, the melt blowing process is preferable.

The nonwoven fabric manufacturing method is a method of manufacturing a nonwoven fabric by a melt blowing process, characterized in that an amount of a resin extruded per orifice of a spinning nozzle is 0.01 g/min or less, a die temperature is set so that the resin exhibits a melt flow rate (MFR) of not less than 500 g/10 min and not more than 1000 g/10 min at the die temperature, a temperature of air ejected to be blown to the resin at a nozzle exit is set to a temperature at which the resin exhibits a melt flow rate (MFR) corresponding to not less than 20% and not more than 80% of the melt flow rate at the die temperature, and an amount of the air ejected per unit area is not less than 50 $Nm^3/sec/m^2$ and not more than 70 $Nm^3/sec/m^2$.

For example, to obtain a nonwoven fabric composed of ultra-fine fibers having an average fiber diameter of 0.80 μm or less, it is necessary to set an amount of a resin extruded per orifice of a spinning nozzle to 0.01 g/min or less. By reducing the amount of the extruded resin, it is possible to reduce the diameter of the molten polymer immediately after being extruded. However, depending on the amount of the air ejected per unit area at the nozzle exit, the following problems may be caused: a large amount of airborne fibers are generated; and tearing of the polymer immediately after being extruded occurs before the polymer turns to fibers, whereby shots are liable to be formed. On this account, it is one characteristic feature that the amount of the air ejected per unit area is not less than 50 $Nm^3/sec/m^2$ and not more than 70 $Nm^3/sec/m^2$. When the amount of a resin extruded per orifice of the spinning nozzle is 0.01 g/min or less, generation of fuzz due to airborne fibers and the formation of shots can be prevented by setting the amount of the air ejected per unit area in the predetermined range so that it is possible to obtain a good-quality nonwoven fabric. Preferably, the amount of the air ejected per unit area is not less than 55 $Nm^3/sec/m^2$ and not more than 67 $Nm^3/sec/m^2$.

In the nonwoven fabric manufacturing method, it is preferable to use a raw material resin exhibiting MFR, that indicates a physical property of a resin, of not less than 10 g/10 min and not more than 2000 g/10 min. MFR, which indicates a physical property of a resin, is measured at a measurement temperature prescribed according to the type of resin. For example, the measurement temperature for polypropylene is 230° C. The die temperature generally is set to a temperature around the measurement temperature of MFR, which indicates a physical property of the resin. Thus, to manufacture a desired nonwoven fabric, it is preferable to use, as an index for selection of a resin, whether the MFR of the resin is in a predetermined range. In the manufacturing method, a die temperature in equipment to manufacture meltblown nonwoven fabrics is set so that a resin to be used exhibits a melt flow rate of not less than 500 g/10 min and not more than 1000 g/10 min at the die temperature, and the temperature of air ejected to be blown to the resin at a nozzle exit is set to a temperature at which the resin exhibits a melt flow rate corresponding to not less than 20% and not more than 80% of the melt flow rate at the die temperature. For example, when the melt flow rate of a certain resin at the set temperature of the die is 500 g/10 min, the temperature at which the resin exhibits a melt flow rate corresponding to 80% of the melt flow rate at the die temperature is a temperature at which the resin exhibits a melt flow rate of 400 g/10 min. When the temperature of the air ejected at the nozzle exit is set to this temperature, the melt flow rate of the resin at this time corresponds to 80% of the melt flow rate at the die temperature. It is more preferable that the temperature of the air ejected at the nozzle exit is set to a temperature at which the resin exhibits a melt flow rate corresponding to not less than 35% and not more than 55% of the melt flow rate at the die temperature.

By setting the temperature of the air ejected to be blown to the resin at the nozzle exit to a temperature at which the resin exhibits a melt flow rate corresponding to not less than 20% and not more than 80% of the melt flow rate at the die temperature, preferably not less than 35% and not more than 55% of the melt flow rate at the die temperature, the surface of the resin (molten polymer) extruded from the nozzle is cooled, and during a process in which the molten polymer is solidified and formed into fibers by the cooling, the straightness of the extruded polymer is improved, thus allowing the extruded polymer to be less liable to be affected by air flow disturbance. When air is blown onto the extruded polymer in this state with the amount of the air ejected per unit area being in the predetermined range, stretching of the molten polymer (i.e., reduction of the fiber diameters) can be performed favorably while preventing mutual fusion of fibers extruded through adjacent orifices of the nozzle. Thus, it is possible to obtain a nonwoven fabric in which the average fiber diameter is reduced while preventing an increase in maximum fiber diameter. By using such a method, it is possible to obtain a nonwoven fabric composed of ultra-fine fibers, in which the ultra-fine fibers have an average fiber diameter of 0.80 μm or less and the proportion of the number of the ultra-fine fibers having a fiber diameter of 2.00 μm or more is 5.0% or less.

As described above, according to the nonwoven fabric manufacturing method, it is possible to obtain a meltblown nonwoven fabric as defined in the above.

EXAMPLES

Example 1

Figure 2A:
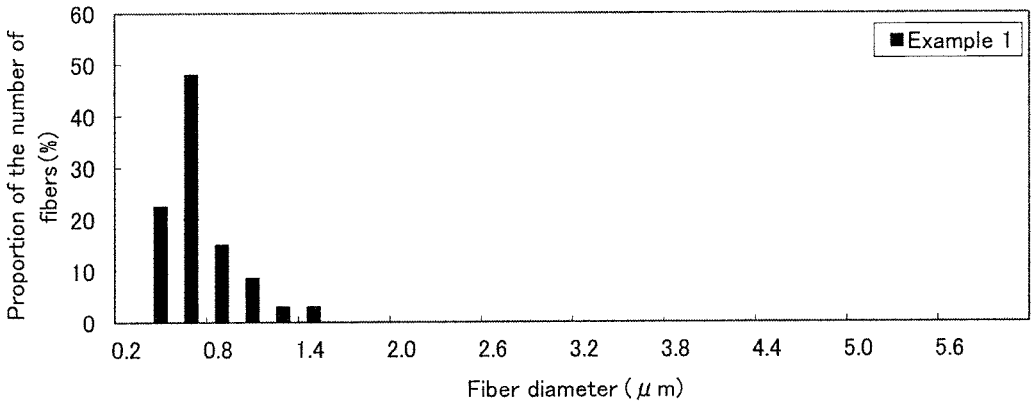
FIGS. 2A to 2C are histograms showing the fiber diameter distribution in nonwoven fabrics according to examples and a comparative example.

Using equipment to manufacture meltblown nonwoven fabrics, a nonwoven fabric was manufactured from a polypropylene resin as a raw material. In this example, a polypropylene resin A (trade name: "Achieve™ 6936G2," manufactured by Exxon Mobil) was used as the raw material. Regarding this polypropylene resin, melt temperatures and melt flow rates at the melt temperatures were measured, and on the basis of the results of the measurement, the relationship between them is shown in the graph of FIG. 1. According to the results obtained, the MFR of the raw material resin at the set temperature of a die (200° C.) was 829 g/10 min, and the MFR of the raw material resin at the set temperature of heated compressed air for fiberization (175° C.) was 440 g/10 min, which corresponds to 53% of the MFR at the die temperature. The above-described polypropylene resin was used, and in the manufacturing equipment, the temperature of the die was set to 200° C., and the amount of the resin extruded per orifice (having a diameter of 0.15 mm) of a spinning nozzle was set to 0.0075 g/min. From both sides of the spinning nozzle, heated compressed air (temperature:

175° C., the amount of the air ejected per unit area: 57 $Nm^3/sec/m^2$) was blown onto the resin, and fibers thus formed collected on a collector placed at a distance of 100 mm from the spinning nozzle. Thus, a meltblown nonwoven fabric having a basis weight of about 10 $g/m^2$ was obtained. The physical properties of the thus-obtained nonwoven fabric were determined by methods to be described below. The results thereof are shown in Table 1. Also, the fiber diameter distribution in the obtained nonwoven fabric is shown in the histogram of FIG. 2A.

Example 2

A nonwoven fabric was obtained in the same manner as in Example 1, except that the amount of the heated compressed air ejected per unit area was set to 65 $Nm^3/sec/m^2$. The physical properties of the thus-obtained nonwoven fabric were determined by methods to be described below. The results thereof are shown in Table 1.

Example 3

A raw material used in the present example was a polypropylene resin B, which exhibits a lower MFR than the polypropylene resin A used in Example 1. Regarding this polypropylene resin B, melt temperatures and melt flow rates at the melt temperatures were measured, and on the basis of the results of the measurement, the relationship between them is shown in the graph of FIG. 1. A nonwoven fabric was obtained in the same manner as in Example 1, except that, on the basis of the results obtained, the temperature of the die was set to 230° C. and the temperature of the heated compressed air was set to 180° C. The MFR of the raw material resin at the set temperature of the die (230° C.) was 915.1 g/10 min, and the MFR of the raw material resin at the temperature of the heated compressed air (180° C.) was 336 g/10 min, which corresponds to 37% of the MFR at the die temperature. The physical properties of the thus-obtained nonwoven fabric were determined by methods to be described below. The results thereof are shown in Table 1.

Example 4

Figure 2B:
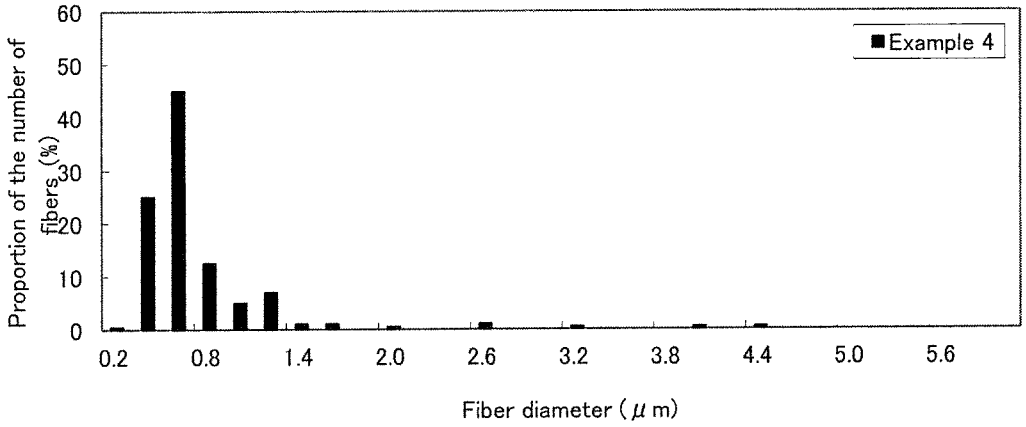

A nonwoven fabric was obtained in the same manner as in Example 3, except that the temperature of the heated compressed air was set to 190° C. and the amount of the heated compressed air ejected per unit area was set to 65 $Nm^3/sec/m^2$. The MFR of the raw material resin at the set temperature of the die (230° C.) was 915.1 g/10 min, and the MFR of the raw material resin at the temperature of the heated compressed air (190° C.) was 403 g/10 min, which corresponds to 44% of the MFR at the die temperature. The physical properties of the thus-obtained nonwoven fabric were determined by methods to be described below. The results thereof are shown in Table 1. Also, the fiber diameter distribution in the obtained nonwoven fabric is shown in the histogram of FIG. 2B.

Comparative Example 1

Figure 2C:
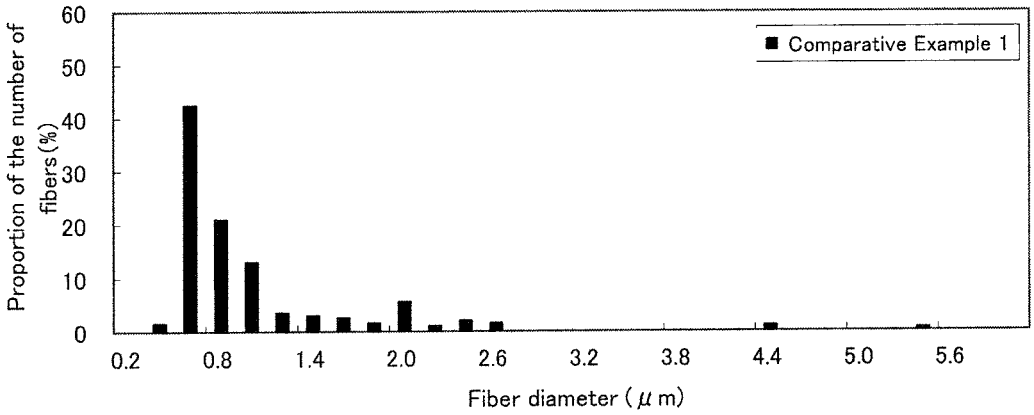

A nonwoven fabric was obtained in the same manner as in Example 1, except that the amount of the heated compressed air ejected per unit area was set to 73 $Nm^3/sec/m^2$. The physical properties of the thus-obtained nonwoven fabric were determined by methods to be described below. The results thereof are shown in Table 1. Also, the fiber diameter distribution in the obtained nonwoven fabric is shown in the histogram of FIG. 2C.

Comparative Example 2

A nonwoven fabric was obtained in the same manner as in Example 1, except that the temperature of the heated compressed air was set to 200° C. and the amount of the heated compressed air ejected per unit area was set to 53 $Nm^3/sec/m^2$. The MFR of the raw material resin at the temperature of the heated compressed air (200° C.) was 829 g/10 min. The MFR of the raw material resin at the set temperature of the die (200° C.) was 829 g/10 min. Thus, the MFR of the raw material resin at the temperature of the heated compressed air corresponds to 100% of the MFR at the die temperature. The physical properties of the thus-obtained nonwoven fabric were determined by methods to be described below. The results thereof are shown in Table 1.

Comparative Example 3

A nonwoven fabric was obtained in the same manner as in Example 1, except that the temperature of the heated compressed air was set to 200° C. and the amount of the heated compressed air ejected per unit area was set to 73 $Nm^3/sec/m^2$. The MFR of the raw material resin at the temperature of the heated compressed air (200° C.) was 829 g/10 min. The MFR of the raw material resin at the set temperature of the die (200° C.) was 829 g/10 min. Thus, the MFR of the raw material resin at the temperature of the heated compressed air corresponds to 100% of the MFR at the die temperature. The physical properties of the thus-obtained nonwoven fabric were determined by methods to be described below. The results thereof are shown in Table 1.

Comparative Example 4

A nonwoven fabric was obtained in the same manner as in Example 1, except that the temperature of the heated compressed air was set to 190° C. and the amount of the heated compressed air ejected per unit area was set to 73 $Nm^3/sec/m^2$. The MFR of the raw material resin at the temperature of the heated compressed air (190° C.) was 654 g/10 min. The MFR of the raw material resin at the set temperature of the die (200° C.) was 829 g/10 min. Thus, the MFR of the raw material resin at the temperature of the heated compressed air corresponds to 79% of the MFR at the die temperature. The physical properties of the thus-obtained nonwoven fabric were determined by methods to be described below. The results thereof are shown in Table 1.

Comparative Example 5

A raw material used in the present example was the polypropylene resin B. A nonwoven fabric was obtained in the same manner as in Example 1, except that the temperature of the die was set to 200° C. and the temperature of the heated compressed air was set to 200° C. The MFR of the raw material resin at the temperature of the die (200° C.) and at the temperature of the heated compressed air (200° C.) were 475 g/10 min. Thus, the MFR of the raw material resin at the temperature of the heated compressed air corresponds to 100% of the MFR at the die temperature. The physical properties of the thus-obtained nonwoven fabric were determined by methods to be described below. The results thereof are shown in Table 1.

Comparative Example 6

A nonwoven fabric was obtained in the same manner as in Example 1, except that the temperature of the die was set to 185° C. and the temperature of the heated compressed air was set to 185° C. The MFR of the raw material resin at the temperature of the die (185° C.) and at the temperature of the heated compressed air (185° C.) were 576 g/10 min. Thus, the MFR of the raw material resin at the temperature of the heated compressed air corresponds to 100% of the MFR at the die temperature. The physical properties of the thus-obtained nonwoven fabric were determined by methods to be described below. The results thereof are shown in Table 1.

Comparative Example 7

Using equipment to manufacture meltblown nonwoven fabrics, a nonwoven fabric was manufactured from the polypropylene resin A as a raw material. The MFR of the raw material resin at the set temperature of a die (200° C.) was 829 g/10 min, and the MFR of the raw material resin at the set temperature of heated compressed air for fiberization (175° C.) was 440 g/10 min, which corresponds to 53% of the MFR at the die temperature. The above-described polypropylene resin was used, and in the manufacturing equipment, the temperature of the die was set to 200° C., and the amount of the resin extruded per orifice (having a diameter of 0.15 mm) of a spinning nozzle was set to 0.025 g/min. From both sides of the spinning nozzle, heated compressed air (temperature: 175° C., the amount of the air ejected per unit area: 57 $Nm^3/sec/m^2$) was blown onto the resin, and fibers thus formed collected on a collector placed at a distance of 100 mm from the spinning nozzle. Thus, a meltblown nonwoven fabric having a basis weight of 20.00 $g/m^2$ was obtained. Three nonwoven fabrics obtained in the above-described manner were stacked. Then, using a calendaring device provided with a pair of steel rolls, they were processed into a laminate with the roll temperature being set to 22° C. as the room temperature, the linear pressure being set to 27 kg/cm, and the processing speed being set to 1 m/min. The thus-obtained calendared meltblown nonwoven fabric was used as the meltblown nonwoven fabric of Comparative Example 7. In the nonwoven fabric of Comparative Example 7, the basis weight was 60.00 $g/m^2$, the thickness was 0.24 mm, the apparent density was 0.250 $g/cm^3$, the average fiber diameter was 1.30 μm, the maximum fiber diameter was 6.21 μm, the maximum pore diameter was 8.5 μm, and the air permeability was 0.6 $cm^3/cm^2/sec$.

TABLE 1

| | | Ex. 1 | Ex. 2 | Ex. 3 | Ex. 4 | Comp. Ex. 1 |
|---|---|---|---|---|---|---|
| 1) Manufacturing conditions | | | | | | |
| Raw material | Resin | PP | PP | PP | PP | PP |
| | Type of resin | A | A | B | B | A |
| Die | Amount of resin extruded per spinning nozzle orifice (g/min) | 0.0075 | 0.0075 | 0.0075 | 0.0075 | 0.0075 |
| | Die temperature (° C.) | 200 | 200 | 230 | 230 | 200 |
| | MFR at die temperature (g/10 min) | 829 | 829 | 915.1 | 915.1 | 829 |
| | Back pressure (mpa) | 1.20 | 1.10 | 1.15 | 1.15 | 1.25 |
| Heated air | Air temperature (° C.) | 175 | 175 | 180 | 190 | 175 |
| | Difference from die temperature (° C.) | −25 | −25 | −50 | −40 | −25 |
| | MFR at air temperature (g/10 min) | 440 | 440 | 336 | 403 | 440 |
| | MFR ratio (%) at die temperature | 53 | 53 | 37 | 44 | 53 |
| | Amount of air ejected per unit area ($Nm^3/sec/m^2$) | 57 | 65 | 57 | 65 | 73 |
| 2) Performance | Average thickness (mm) | 0.10 | 0.11 | 0.09 | 0.10 | 0.11 |
| | Average basis weight ($g/m^2$) | 9.57 | 10.13 | 9.63 | 10.2 | 9.67 |
| | Apparent density ($g/cm^3$) | 0.096 | 0.092 | 0.107 | 0.102 | 0.088 |
| | Average fiber diameter (μm) | 0.56 | 0.66 | 0.75 | 0.75 | 0.86 |
| | Maximum fiber diameter (μm) | 1.29 | 1.39 | 1.61 | 4.30 | 5.20 |
| | Maximum pore diameter (μm) | 6.8 | 8.9 | 7.8 | 10.0 | 12.3 |
| | Average pore diameter (μm) | 3.2 | 3.5 | 3.9 | 4.3 | 4.3 |
| | Air permeability ($cm^3/cm^2/sec$) | 8.9 | 12.0 | 12.9 | 13.7 | 15.8 |
| | Air permeability/maximum pore diameter ($cm^3/cm^2/sec$)/(μm) | 1.31 | 1.34 | 1.65 | 1.37 | 1.29 |
| | Proportion of fibers with ϕ of 2.00 μm or more (%) | 0.0 | 0.0 | 0.0 | 2.5 | 6.0 |

TABLE 1-continued

| | | | | | | |
|---|---|---|---|---|---|---|
| | Appearance (shots) | A | A | A | A | A |
| | | Comp. Ex. 2 | Comp. Ex. 3 | Comp. Ex. 4 | Comp. Ex. 5 | Comp. Ex. 6 |
| 1) Manufacturing conditions | | | | | | |
| Raw material | Resin | PP | PP | PP | PP | PP |
| | Type of resin | A | A | A | B | A |
| Die | Amount of resin extruded per spinning nozzle orifice (g/min) | 0.0075 | 0.0075 | 0.0075 | 0.0075 | 0.0075 |
| | Die temperature (° C.) | 200 | 200 | 200 | 200 | 185 |
| | MFR at die temperature (g/10 min) | 829 | 829 | 829 | 475 | 576 |
| | Back pressure (mpa) | 0.90 | 0.80 | 0.95 | 1.15 | 1.20 |
| Heated air | Air temperature (° C.) | 200 | 200 | 190 | 200 | 185 |
| | Difference from die temperature (° C.) | 0 | 0 | −10 | 0 | 0 |
| | MFR at air temperature (g/10 min) | 829 | 829 | 654 | 475 | 576 |
| | MFR ratio (%) at die temperature | 100 | 100 | 79 | 100 | 100 |
| | Amount of air ejected per unit area ($Nm^3/sec/m^2$) | 53 | 73 | 73 | 57 | 57 |
| 2) Performance | Average thickness (mm) | 0.20 | 0.18 | 0.12 | 0.10 | 0.10 |
| | Average basis weight ($g/m^2$) | 10.03 | 10.05 | 10.18 | 9.46 | 9.57 |
| | Apparent density ($g/cm^3$) | 0.050 | 0.056 | 0.085 | 0.095 | 0.096 |
| | Average fiber diameter (μm) | 0.63 | 0.71 | 0.79 | 0.68 | 0.53 |
| | Maximum fiber diameter (μm) | 4.33 | 4.91 | 2.52 | 2.67 | 1.34 |
| | Maximum pore diameter (μm) | 21.9 | 14.5 | 11.1 | 12.7 | 12.4 |
| | Average pore diameter (μm) | 4.9 | 4.2 | 4.1 | 4.6 | 3.6 |
| | Air permeability ($cm^3/cm^2/sec$) | 15.9 | 14.7 | 12.6 | 14.8 | 13.5 |
| | Air permeability/maximum pore diameter ($cm^3/cm^2/sec$)/(μm) | 0.73 | 1.02 | 1.13 | 1.17 | 1.09 |
| | Proportion of fibers with ϕ of 2.00 μm or more (%) | 6.5 | 5.5 | 5.0 | 5.5 | 0.0 |
| | Appearance (shots) | C | C | B | B | B |

The nonwoven fabrics of Examples 1 to 4 all exhibited high air permeability (8.5 $cm^3/cm^2/sec$ or more) while they all had a maximum pore diameter of 10.0 μm or less. Moreover, shots or fuzz was not observed in their appearance.

In contrast, in the nonwoven fabric of Comparative Example 1, the maximum fiber diameter was more than 5 μm, the proportion of fibers having a fiber diameter of 2.00 μm or more was 6.0%, and the maximum pore diameter was more than 12 μm. The reason for this is believed to be that the amount of the air ejected per unit area at the nozzle exit was large so that mutual fusion of fibers extruded through adjacent orifices of the nozzle was caused. Also, in the nonwoven fabric of Comparative Example 1, fuzz was found through observation of the appearance. The reason for this is believed to be that, since the amount of the air ejected per unit area was large, the air flowed faster so that tearing of the polymer was caused after the polymer had been cooled and formed into fibers.

In the nonwoven fabric of Comparative Example 2, the maximum fiber diameter was large (4.33 μm), the proportion of fibers having a fiber diameter of 2.00 μm or more was 6.5%, and the maximum pore diameter was 21.9 μm. In the nonwoven fabric of Comparative Example 3, the maximum fiber diameter was large (4.91 μm), the proportion of fibers having a fiber diameter of 2.00 μm or more was 5.5%, and the maximum pore diameter was 14.9 μm. The reason for these is believed to be as follows. In Comparative Examples 2 and 3, the temperature of the air ejected at the nozzle exit was the same as the die temperature. Thus, cooling of the polymer for solidification performed at the same time as making the polymer thinner by blowing hot air onto the polymer from side surfaces of the nozzle after the polymer had been extruded from the spinning nozzle was not achieved sufficiently so that mutual fusion of fibers extruded through adjacent orifices of the nozzle was more liable to occur. Further, the polymer kept its temperature without being cooled by the air blown onto the polymer in the vicinity of the nozzle exit so that a rise in resin viscosity in the vicinity of the nozzle exit was prevented. Since the polymer had a low viscosity, the back pressure in Comparative Example 2 was lower than those in the examples. Due to this low back pressure, the polymer was extruded unevenly. The straightness of the polymer thus became unstable, resulting in formation of shots. In Comparative Example 3, the amount of the air ejected per unit area at the nozzle exit was large and the back pressure was low. Thus, for the same reason as described above, mutual fusion of fibers extruded through the adjacent orifices of the nozzle was caused to increase the maximum fiber diameter and, also, the straightness of the polymer became unstable, resulting in formation of shots.

The nonwoven fabric of Comparative Example 4 was manufactured under the condition where the amount of the air ejected per unit area at the nozzle exit was large, similarly to the nonwoven fabrics of Comparative Examples 1 and 3. Thus, we believe that mutual fusion of fibers extruded through the adjacent orifices of the nozzle was caused. In Comparative Example 4, the temperature of the air ejected in the vicinity of the nozzle exit was higher than that in Comparative Example 1. Accordingly, we believe that the fibers were stretched more so that the nonwoven fabric of Comparative Example 4 had a smaller maximum fiber diameter (2.52 μm) than the nonwoven fabric of Comparative Example 1. Furthermore, in Comparative Example 4, the temperature of the air ejected in the vicinity of the nozzle exit was lower than that in Comparative Example 3. Accordingly, we believe that mutual fusion of fibers extruded through the adjacent orifices of the nozzle was less liable to occur as compared with Comparative Example 3 so that the nonwoven fabric of Comparative Example 4 had a smaller maximum fiber diameter (2.52 μm) than the nonwoven fabric of Comparative Example 3. In Comparative Example 4, as compared to the conditions in the examples, the temperature of the ejected air was higher, the difference between the melt flow rate of the resin at the die temperature and the melt flow rate of the resin at the temperature of the ejected air was smaller, and the back pressure lower. Accordingly, we believe that, due to the low back pressure, the force to extrude the polymer (the amount of the polymer extruded) and the straightness of the polymer immediately after being extruded tend to be unstable, resulting in formation of shots. Also, in the nonwoven fabric of Comparative Example 4, fuzz was found through observation of the appearance. The reason for this is believed to be that, since the amount of the air ejected per unit area was large, the air flowed faster so that tearing of the polymer was caused after the fiberization.

The nonwoven fabric of Comparative Example 5 was manufactured using the same resin as in Example 3. In Comparative Example 5, the die temperature was set so that the same back pressure as in Example 3 was obtained and, also, the amount of air ejected per unit area was set to be the same as in Example 3. In Comparative Example 5, the temperature of the air was set to be the same as the temperature of the die. As a result, the maximum fiber diameter in the obtained nonwoven fabric was greatly different from that in the nonwoven fabric of Example 3. The reason for this is believed to be as follows. In Comparative Example 5, since the temperature of the air was the same as the temperature of the die, the surface of the molten polymer was not cooled. Thus, the straightness of the polymer was lost, resulting in formation of shots and fusion of fibers.

The nonwoven fabric of Comparative Example 6 was obtained using the same resin as in Example 1 under the conditions where the amount of the ejected air was the same as in Example 1, the temperature of the die was the same as the temperature of the air (i.e., the difference in temperature between them was 0), and the back pressure was set to be the same as in Example 1. As a result, although the nonwoven fabric of Comparative Example 6 had a favorable average fiber diameter and a favorable maximum fiber diameter similarly to the nonwoven fabric of Example 1, the nonwoven fabric of Comparative Example 6 had a large maximum pore diameter owing to the influence of shots. The reason for this is believed to be as follows. In Comparative Example 6, since the temperature of the air was the same as the temperature of the die as in Comparative Example 5, the surface of the molten polymer was not cooled. Thus, the straightness of the polymer was lost, resulting in formation of shots.

The nonwoven fabric of Comparative Example 7 was subjected to the calendering process to reduce the maximum pore diameter. Although the nonwoven fabric of Comparative Example 7 had a maximum pore diameter of 10.0 μm or less, the air permeability thereof was low (0.6 $cm^3/cm^2/sec$).

As described above, in each of the examples, a nonwoven fabric that has high air permeability while it has a small maximum pore diameter could be obtained.

The properties of the nonwoven fabrics obtained in the examples and the comparative examples were determined in the following manners.

Average Thickness

The average thickness was determined in the following manner. A test piece of 250 mm×250 mm was cut out from a meltblown nonwoven fabric of interest. The thickness of this cut piece was measured at four points, specifically, the midpoints of the respective sides, using a dial thickness gauge. The average value of the thus-obtained measured values was calculated, and the calculated value was rounded off to two decimal places.

Average Basis Weight

The average basis weight was determined in the following manner. Three test pieces (250 mm×250 mm each) were cut out from the meltblown nonwoven fabric, and they were weighed using an electronic balance. The average value of the weights of these three test pieces was calculated. Then, the average value was multiplied by 16, and the calculated value was rounded off to two decimal places.

Apparent Density

The apparent density was determined in the following manner. From the average thickness and the average basis weight determined in the above-described manners, the apparent density was calculated using the following equation, and the calculated value was rounded off to three decimal places.

$$\text{Apparent density } (g/cm^3) = \{\text{Average basis weight } (g/m^2)/\text{Average thickness } (mm)\}/1000$$

Average Fiber Diameter, Maximum Fiber Diameter, and Proportion of Fibers

The average fiber diameter and the maximum fiber diameter were determined by measuring fiber diameters of the meltblown nonwoven fabric on photographs taken at a magnification of 3000× by an electron microscope. The average fiber diameter was determined by randomly sampling 200 fibers in total from ten photographs, measuring the fiber diameters of these 200 fibers on the order of 0.01 μm, calculating the average value of the thus-measured fiber diameters, and rounding off the calculated value to two decimal places. The maximum fiber diameter was the largest fiber diameter among the diameters of the 200 fibers. Further, the number of fibers having a fiber diameter of 2.00 μm or more was divided by the number of all the fibers subjected to the measurement, and the percentage thereof was calculated. The calculated value was rounded off to one decimal place.

Maximum Pore Diameter

The maximum pore diameter was determined according to a bubble point method (JIS K3832[1990]). According to the following test method carried out using an automatic pore diameter distribution measuring instrument (model: "CFP-1200AEXCS," manufactured by Porous materials, Inc.), the bubble point value was measured. From the thus-obtained bubble point value, a maximum pore diameter was calculated using Equation (1) shown below, and the calculated value was rounded off to one decimal place.

Test Method

A test piece of the meltblown nonwoven fabric was impregnated with a reagent (GALWICK, surface tension: 15.9 dyn/cm=15.9 mN/m) so that the test piece was completely wet with the reagent and the contact angle between the liquid (reagent) and the sample (the meltblown nonwoven fabric) was zero. The test piece of the meltblown nonwoven fabric impregnated with the reagent was set in a holder of the measuring instrument, and the bubble point value was measured.

$$d=Cr/P \quad (1)$$

d=maximum pore diameter (μm)
r=surface tension of reagent (15.9 mN/m)
P=differential pressure (Pa)
C=pressure constant (2860)

Average Pore Diameter

A dry test piece of the meltblown nonwoven fabric was set in the above-described automatic pore diameter distribution measuring instrument. An air pressure applied onto one surface of the test piece was increased gradually, and a dry flow curve, which indicates the relationship between the pressure when air passed through the dry test piece and the flow rate, was determined. The pressure when the air started to pass through the dry test piece was indicated as $P_1$. Then, on the basis of the dry flow curve, a half-dry flow curve was prepared by reducing the flow rate of the air passing through the test piece to one-half. The test piece was then immersed in the above-described reagent. Thereafter, a wet flow curve was obtained through the same measurement procedure.

The average pore diameter $d_m$ was calculated from the pressure $P_2$ at the intersection between the half-dry flow curve and the wet flow curve and the differential pressure $P_c$ between $P_2$ and $P_1$ using Equation (2). The calculated value was rounded off to one decimal place.

$$d_m=Cr/P_c \quad (2)$$

$d_m$=average pore diameter (μm)
r=surface tension of liquid (15.9 mN/m)
$P_c$=differential pressure ($P_2$-$P_1$) (Pa)
C=pressure constant (2860)

Air Permeability

Five test pieces (200 mm×200 mm each) were cut out from the meltblown nonwoven fabric, and the air permeability was measured by a method pursuant to JIS L 1096 (A-method: Frazier method) using an air permeability test/air permeability measuring instrument (FX3300, manufactured by TEXTEST). In the measurement, the amount of air passing through an area of 1 $cm^2$ ($cm^3/cm^2/sec$) was determined. The average value of the amounts of the air determined for the five test pieces was calculated. The calculated value was rounded off to one decimal place. The thus-obtained value was regarded as the air permeability.

Air Permeability ($cm^3/cm^2/sec$)/Maximum Pore Diameter (μm)

The value of Air permeability ($cm^3/cm^2/sec$)/Maximum pore diameter (μm) was calculated from the value of the maximum pore diameter and the value of the air permeability obtained in the above measurements. The calculated value was rounded off to two decimal places.

Appearance

The appearance of the meltblown nonwoven fabric was evaluated on the basis of the following evaluation criteria.

Shots

A: The nonwoven fabric includes no shots and is applicable as a commercial product.
B: Although the nonwoven fabric has a small number of shots, it is applicable as a commercial product.
C: The nonwoven fabric includes a large number of shots and is not applicable as a commercial product.

The nonwoven fabric is highly uniform and has high air permeability while it has a small maximum pore diameter. Accordingly, the nonwoven fabric can be used suitably as various types of filters, in particular, liquid filters. Furthermore, according to the nonwoven fabric manufacturing method, it is possible to obtain a highly uniform nonwoven fabric having high air permeability and a small maximum pore diameter.

The invention claimed is:

1. A meltblown nonwoven fabric comprising:
ultra-fine fibers having an average fiber diameter of 0.80 μm or less,
wherein a value obtained by dividing an air permeability ($cm^3/cm^2/sec$) by a maximum pore diameter (μm) (Air permeability [$cm^3/cm^2/sec$]/Maximum pore diameter [μm]) is 1.30 or more, and a proportion of a number of the ultra-fine fibers having a fiber diameter of 2.00 μm or more is 5.0% or less, and
the meltblown nonwoven fabric has an apparent density of not less than 0.05 $g/cm^3$ and not more than 0.15 $g/cm^3$, a maximum pore diameter of 10.0 μm or less, and an average basis weight of at least 9 $g/m^2$.

2. A meltblown nonwoven fabric comprising:
ultra-fine fibers having an average fiber diameter of 0.80 μm or less,
wherein a value obtained by dividing an air permeability ($cm^3/cm^2/sec$) by a maximum pore diameter (μm) (Air permeability [$cm^3/cm^2/sec$]/Maximum pore diameter [μm]) is 1.30 or more,
the ultra-fine fibers are formed of a thermoplastic resin, and a proportion of a number of the ultra-fine fibers having a fiber diameter of 2.00 μm or more is 5.0% or less, and
the meltblown nonwoven fabric has an apparent density of not less than 0.05 $g/cm^3$ and not more than 0.15 $g/cm^3$, a maximum pore diameter of 10.0 μm or less, and an average basis weight of at least 9 $g/m^2$.

3. A meltblown nonwoven fabric comprising:
ultra-fine fibers having an average fiber diameter of 0.80 μm or less,
wherein a value obtained by dividing an air permeability ($cm^3/cm^2/sec$) by a maximum pore diameter (μm) (Air permeability [$cm^3/cm^2/sec$]/Maximum pore diameter [μm]) is 1.30 or more,
the ultra-fine fibers are formed of polypropylene, and a proportion of a number of the ultra-fine fibers having a fiber diameter of 2.00 μm or more is 5.0% or less, and
the meltblown nonwoven fabric has an apparent density of not less than 0.05 $g/cm^3$ and not more than 0.15 $g/cm^3$, a maximum pore diameter of 10.0 μm or less, and an average basis weight of at least 9 $g/m^2$.

* * * * *